United States Patent [19]

Markwardt

[11] Patent Number: 4,834,668

[45] Date of Patent: May 30, 1989

[54] ELECTRICAL CONNECTOR (CUT-OFF THROUGH THE COVER)

[75] Inventor: Terrance L. Markwardt, Cedar Park, Tex.

[73] Assignee: Minnesota Mining and Manufacturing Company, St. Paul, Minn.

[21] Appl. No.: 152,447

[22] Filed: Feb. 5, 1988

[30] Foreign Application Priority Data

Feb. 20, 1987 [JP] Japan ..... 62-37694

[51] Int. Cl.[4] ..... H01R 4/24

[52] U.S. Cl. ..... 439/392; 439/417; 439/695

[58] Field of Search ..... 439/389–414, 439/417–419, 443, 444, 695, 701

[56] References Cited

U.S. PATENT DOCUMENTS

| | | | |
|---|---|---|---|
| 3,848,954 | 11/1974 | Sedlacek | 439/392 |
| 4,284,316 | 8/1981 | Debaigt | 439/392 |
| 4,444,448 | 4/1984 | Silbernagel | 439/392 |
| 4,526,434 | 7/1985 | Saligny | 439/392 |
| 4,679,881 | 7/1987 | Galvin et al. | 439/392 |

FOREIGN PATENT DOCUMENTS

| | | | |
|---|---|---|---|
| 3313654 | 10/1984 | Fed. Rep. of Germany | 439/392 |

*Primary Examiner*—David Pirlot

*Attorney, Agent, or Firm*—Donald M. Sell; Walter N. Kirn; John C. Barnes

[57] ABSTRACT

An electrical connector for connecting telephone cables wherein an end of each wire is connected to a part of the connector and then cut through cutoff holes in the connector cover, and when the connector parts are assembled to splice the cables said cover has portions to cover the cutoff holes.

8 Claims, 10 Drawing Sheets

ELECTRICAL CONNECTOR (CUT-OFF THROUGH THE COVER)

BACKGROUND OF THE INVENTION

1. Field of the Invention

This invention relates to a connector for splicing telephone cables and, in particular, to a connector suitable for splicing telephone cables comprising copper wires whose diameters are in the range from 0.3 mm to 0.9 mm inclusive.

2. Description of the Prior Art

Among any prior art connectors for splicing telephone cables one is well known in which the telephone cable wires are placed on the body of a connector and the surplus portions of said wires are cut off using a tool before mounting a cover. Others also well known include one whose body has cutoff blades embedded on the prescribed position so as to enable automatic cutting of the wires when the cover is pressed onto the body after the wires are placed on said body.

When using the prior art connectors above described, it is required in the former one to cut off the wires before mounting the cover, and as such its handling is complicated. The latter one, on the other hand, is complicated in structure since its cutoff blades are built in the body. The present invention intends, by solving these problems, to provide a connector for telephone cables which is simple not only in structure but also in handling.

SUMMARY OF THE INVENTION

According to the invention, the cover is formed on its edge portion with holes through which wire cutoff blades can extend so that even after the cover has been mounted to the body such holes make it possible to cut off the lengths of surplus wires with ease.

DESCRIPTION OF THE PREFERRED EMBODIMENT

In the following, a preferred embodiment of the invention will be described with the reference to the accompanying drawings.

Figure 3:
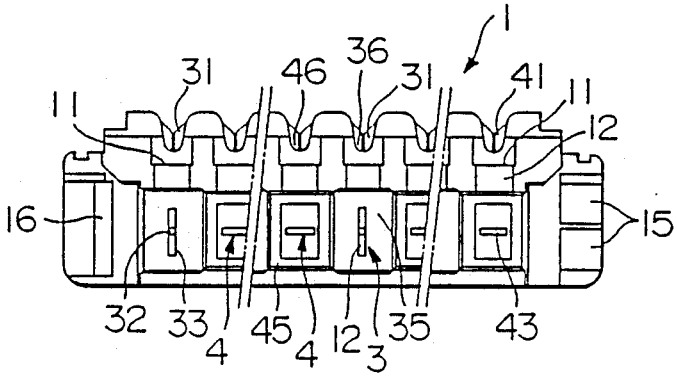
FIG. 3 is a front view of the body shown in FIG. 2.
Figure 4:
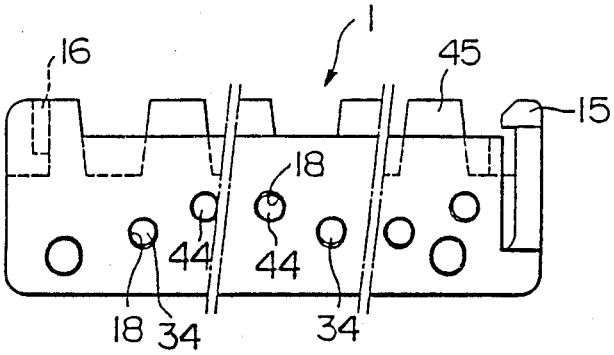
FIG. 4 is a bottom view of the body shown in FIG. 2.
Figure 5:
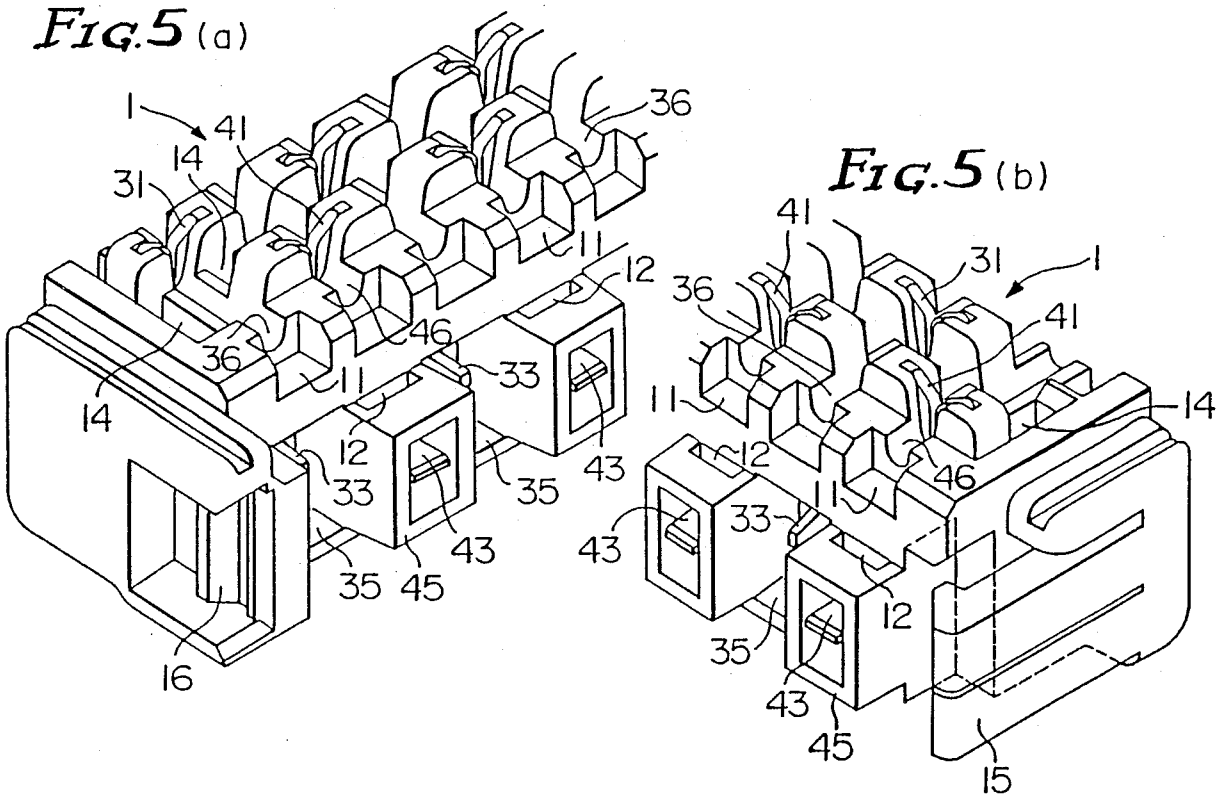
FIGS. 5(*a*) and 5(*b*) are an enlarged perspective view showing essential portions of the body shown in FIG. 2, in which (*a*) shows one end portion and (*b*) shows the other end portion of the same body and also an end portion of the other body.
Figure 6:
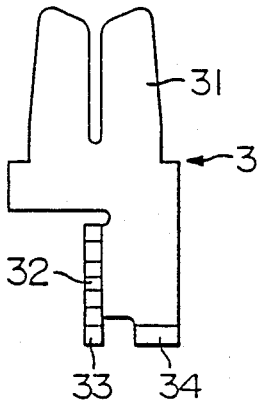
FIGS. 6(*a*) and 6(*b*) are an enlarged view of a female contact element mounted to the body shown in FIG. 2, in which (*a*) is a front view and (*b*) is a side view.
Figure 6:
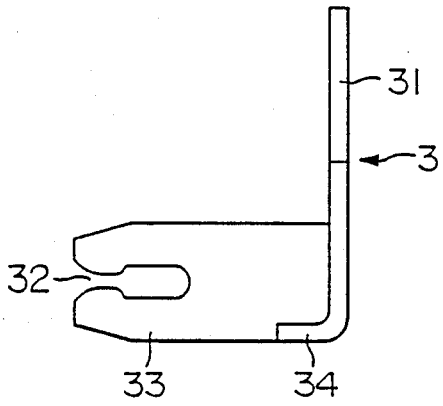
Figure 7:
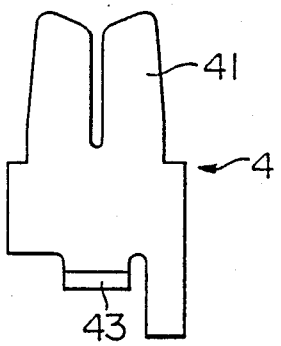
FIG. 7(*a*) and 7(*b*) are an enlarged view of a male contact element mounted to the body shown in FIG. 1, in which (*a*) is a front view and (*b*) is a side view.
Figure 7:
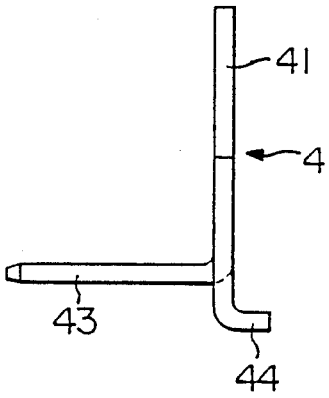
Figure 8:
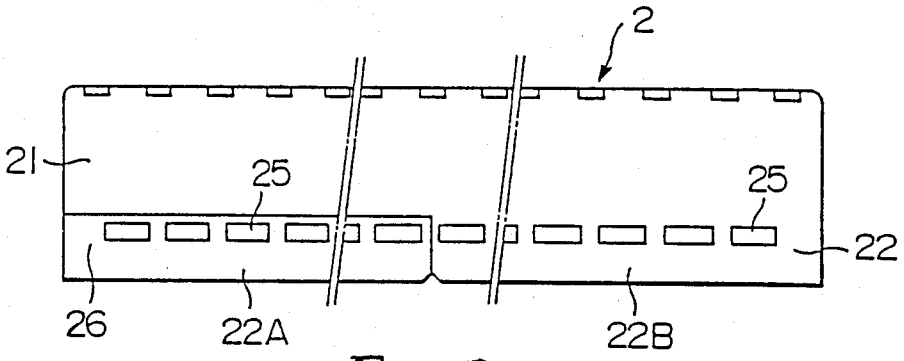
FIG. 8 is a plan view of a cover mounted to the body shown in FIG. 2.
Figure 9:
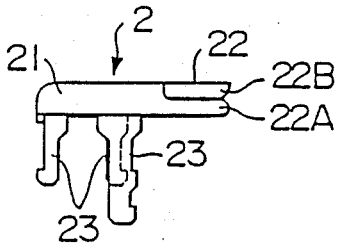
FIG. 9 is a side view of the cover shown in FIG. 8.
Figure 10:
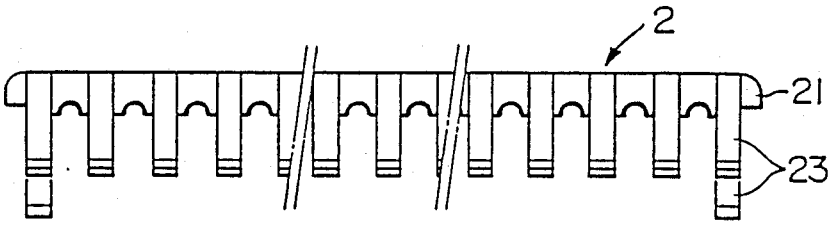
FIG. 10 is a rear view of the cover shown in FIG. 8.
Figure 11:
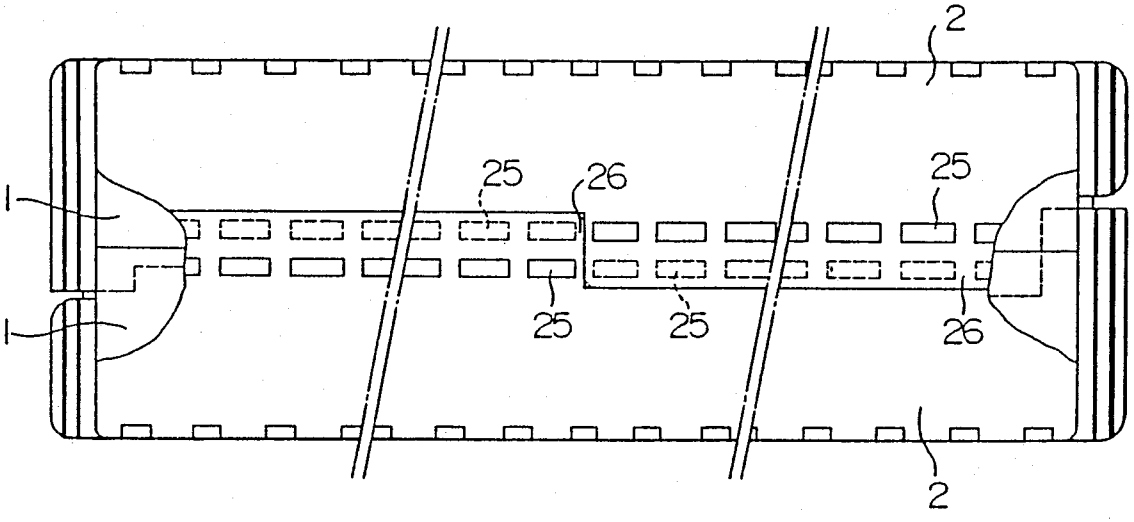
FIG. 11 is a plan view of a connector having a pair of bodies connected respectively to a pair of covers.
Figure 12:
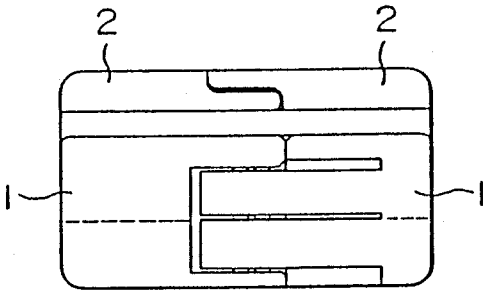
FIGS. 12 is a side view of the connector shown in FIG. 11.
Figure 13:
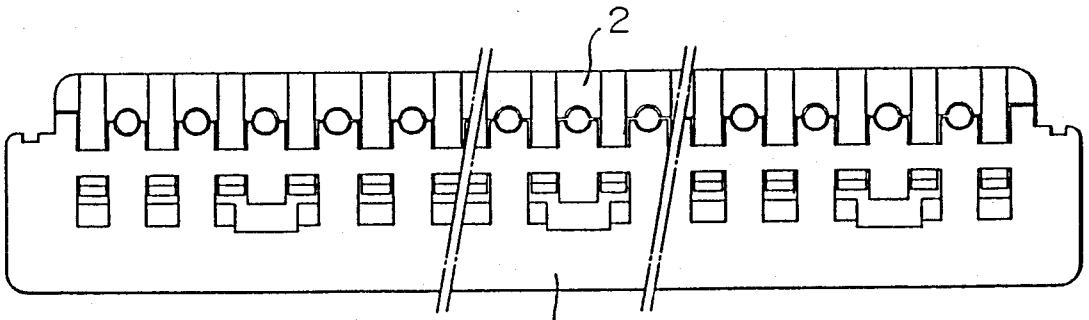
FIG. 13 is a rear view of the connector shown in FIG. 11.

The invention connector comprises two bodies 1 as seen in FIGS. 1 to 5 and two covers 2 mounted respectively to the two bodies as seen in FIGS. 8 to 10. Each of the bodies 1 is provided with a female contact element 3 as shown in FIG. 3 and a male contact element 4 as shown in FIG. 7.

The female contact element 3 is configured generally L-shaped and comprises a U-shaped wire receiving portion 31 at one end thereof and comprises at the other end thereof a terminal 33 having an opening 32. And, the female contact element 3 has a portion thereof bent to define a testing tab 34.

The male connector element 4 is also configured in a generally L-shape and comprises a U-shaped wire receiving portion 41 at one end thereof and comprises at the other end thereof a terminal 43 of a thickness fitting dimensionally to the opening 32 of the female contact element 3, and said male contact element 4 has a portion thereof bent to define a testing tab 44.

The female contact elements 3 and male contact elements 4, structured as above described, are alternatively arranged on the body 1 so as to be capable of respectively engaging with the similarly structured mating contact elements of the other body 1.

At the frontal face of the body 1, the terminal 43 of the male contact element 4 is surrounded by a square wall 45 of an insulated material and the terminal 33 of the female contact element 3 is positioned within a recess 35 formed between the adjacent walls 45. Each wall 45 approximately corresponds in its outer configuration to that of each recess 35 so that the wall 45 of one body may be guided into the recess 35 of the other body so as to be positively fitted therein.

At the upper portion of the body 1, the wire receiving portions 31, 41 of the female and male contact elements 3, 4 project in a zigzagged manner toward each other. And, adjacent to these wire receiving portions 31, 41 are formed wire paths 36, 46 in which wires 5 (see FIGS. 17, 18) can be placed. Further, the paths 36, 46 are formed on the respective front lateral end portions of the body with wire cutoff pads 11 against which wire cutoff blades 6, to be later described, may strike.

Within the interior of the body 1, a passage 13 (FIG. 19) is formed which extends from the space around the male terminal 43 to a grease distributing hole 12 in the vicinity of the wire receiving portion 41. Through this passage 13, as described later, grease may be supplied to the wire receiving portions 41, 31, etc.

Further, the body 1 is formed with openings 14 which can receive therein legs 23 described later of a cover 2. Furthermore, on one end portion thereof, the body 1 is formed with locking claws 15 and, on the other end portions, formed with projections 16 which can complementarily engage with the claws 15. Besides, the body 1, on its bottom portion, is formed with openings 18 through which the respective tabs 34, 44 of the female and male contact elements 3, 4 can be exposed so as to allow inspection of the state of the wires 5 which have been mounted.

Now, an explanation will be made of the connector cover 2, referring to FIG. 1 and FIGS. 8 to 10.

Figure 14:
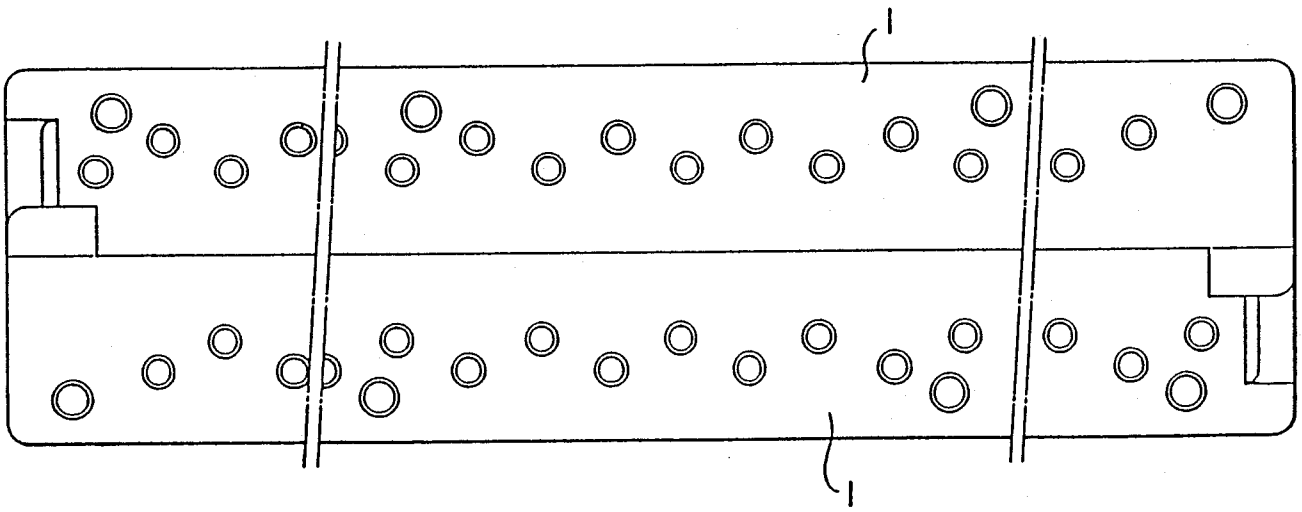
FIG. 14 is a bottom view of the connector shown in FIG. 11.

The cover 2 comprises a planar cover body 21 capable of covering the main portion of the body 1 and a rather thinwalled edge portion 22 extending along said cover body 21. The cover body 21 is provided on the lower portion thereof with a number of the legs 23 insertable into the openings 14 defined in the connector body 1. Each leg 23 has a projection 24 made thereon so as to be engagedly held by the projection 16 (FIGS. 14 to 16) formed in the opening 14 of the connector body 1.

On the edge portion 22 of the cover 2, there are wire cutoff holes 25 formed along the edge of the cover respectively at the places which will come above the wire cutoff pads 11 when the cover 2 is assembled to the connector body 1. And, on the outside of the wire cutoff holes 25, there are left, along the edge of the cover 2, hole covering portions 26 for respectively covering similar holes on the counterpart cover constituting a pair with the cover 2.

Further, the edge portion 22 is divided nearly at the center thereof into two portions 22A, 22B of an almost same length, one portion 22A, as seen from FIG. 8, being made lower than the other portion 22B by the distance corresponding to the thickness of the edge portion 22. Thus, when two similarly structured covers 2, 2 are assembled together as shown in FIG. 10, the lower portion 22A of one cover 2 is capable of being inserted to the under side of the higher portion 22B of the other cover 2 so that the top surfaces of two covers 2, 2 may become substantially coplanar and moreover the respective hole covering portions 26 may positively block the other cover holes 25 from the upper or under side thereof.

FIGS. 11, 12, 13, and 14 show the state of the connector when its pair of bodies 1, 1 and pair of covers 2, 2 have all been connected to each other. In these drawings, however, the illustrations of telephone cable wires are omitted.

Figure 15:
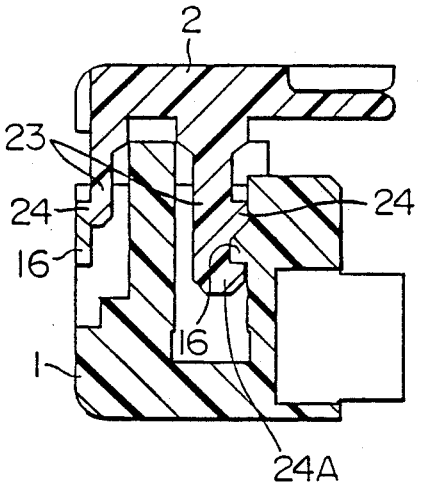
FIG. 15, 16, and 17 are enlarged views jointly showing a sequence for connecting as shown in FIG. 11 the bodies and covers each other, FIG. 15 being a sectional view of one connector half, FIG. 16 being a sectional view of the other connector half, and FIG. 17 being a sectional view showing the connector constructed by mutually connecting the connector halves respectively shown in FIG. 15 and FIG. 16.

To connect as noted above a pair of similarly structured bodies 1, 1 and a pair of similarly structured covers 2, 2 to each other, first of all, as shown in FIGS. 15, onto one body 1 is placed one cover 2, which then is subjected to a strong pressure so that the projection 24 of the leg 23 on the cover 2 is engagedly locked by the projection 16 of the body 1 thereby achieving integral connection thereof. In the preferred embodiment, each leg 23 is provided, in addition to the projection 24 for final locking of the cover 2, with rather smaller projections 24A for temporary locking of the cover 2.

Figure 16:
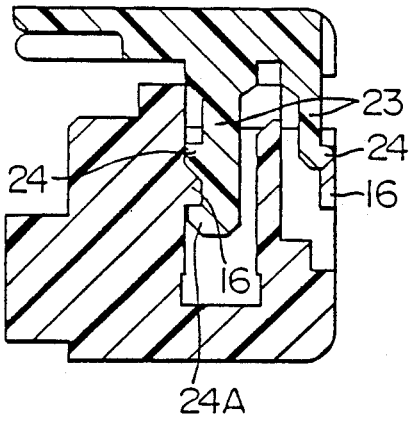

Similarly, to the other body 1 is connected the other cover 2 by way of a step shown in FIG. 16.

Figure 17:
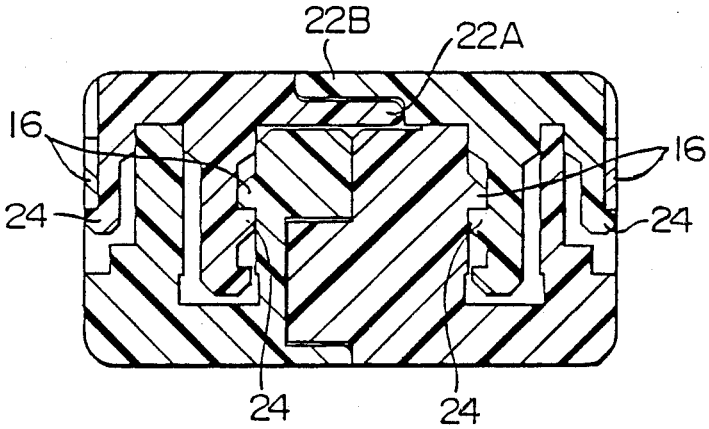

Thus, by then mutually pressing as shown in FIG. 17 two connector halves in each of which the body 1 has been connected to the cover 2, the wall 45 of one body 1 is caused to fit into the recess of the counterpart body 1 and the lower edge portion 22A of one cover 2 is inserted into the under side of the higher edge portion 22B of the other cover 2 so that the holes 25 of the covers 2 are covered as previously described. Naturally, at this time, into the opening 32 of each female terminal 33 is inserted each male terminal 43 correspondingly to the latter so that each of the contact elements 3, 4 can be subjected to mutual electric connection. Besides, the claws 15 of the body 1 are caused to be engaged with and locked by the projections 16 of the counterpart body 1 thereby assuring their positive connection.

Next, a method of splicing telephone cable wires using the connector of this invention will be explained referring to FIGS. 1, 18, and 19.

Figure 18:
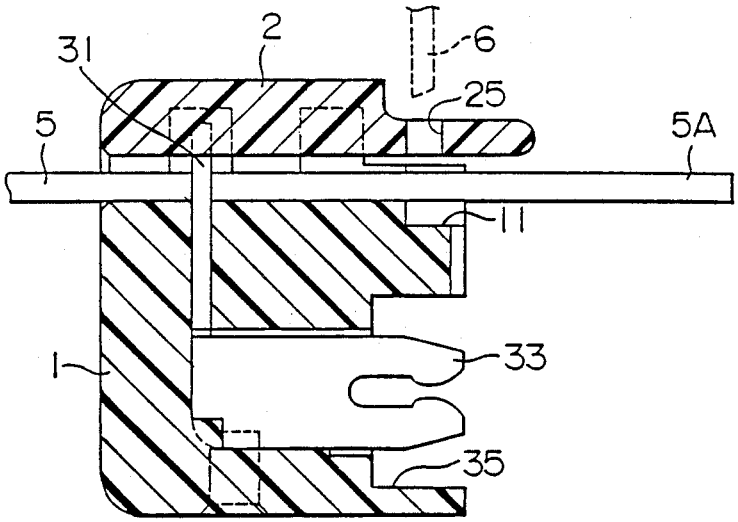
FIGS. 18 and 19 are enlarged views jointly showing a sequence for splicing telephone cable wires by the invention connector, FIG. 18 being a sectional view of one connector half, and FIG. 19 being a sectional view of the other connector half.
Figure 19:
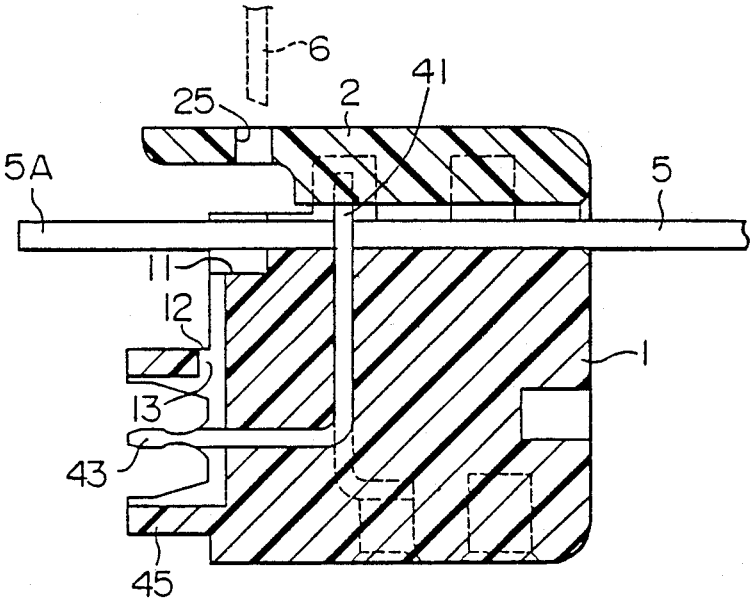

Firstly, as shown in FIGS. 18 and 19, the wires 5 are placed respectively in the wire receiving portions 31, 41 of the bodies 1 with surplus portions 5A of the wires 5 being retained respectively on the wire cutoff pads 11.

Then, the covers 2 are respectively pressed onto the bodies 1 as previously described. As a result, the wires 5 are electrically connected to the respective contact elements 3, 4 in the manner well known in the art.

In such condition, through the wire cutoff holes 25 of the covers 2 the wire cutoff blades 6 are pushed down to the pads 11 using a desired tool (not shown), thereby the surplus portions 5A of all the wires 5 are cut off.

Figure 1:
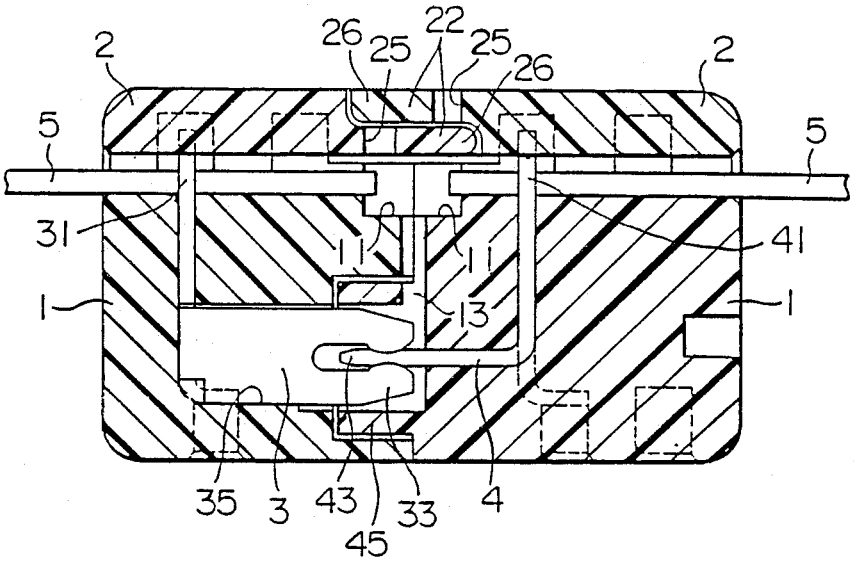
FIG. 1 is a sectional view of a connector according to the invention.
Figure 2:
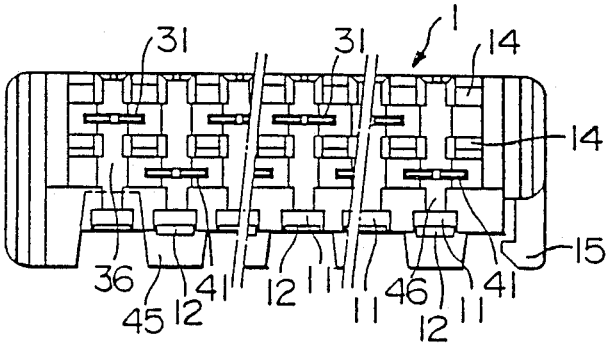
FIG. 2 is a plan view of one body for the connector shown in FIG. 1.

Then, these two bodies 1 are connected each other as shown in FIG. 1, which completes the electrical connection for the wires 5.

At this time, if the space defined by the wall 5 of the male terminal 43 has been preloaded with grease or the like, two bodies 1, when urged, cause a pumping operation by which the grease is driven out onto the upper surface of the body 1 automatically from the hole 12 through the passage 13, thus enabling effective sealing thereby. On the other hand, the grease within each of the recesses 35, 45 about the respective terminals 33, 43 is distributed onto the upper portion from the openings 14 through the gaps around these terminals.

In the foregoing, the pressing of the covers 2 onto the bodies 1 was described as an operation independent of that for pushing down the blades 6. The connector, of the present invention, however, also makes it possible to complete the two kinds of operations in a single handling.

Effect of the Invention

As noted above, according to the invention connector, the surplus portions of the wires can be cut off even after the connector bodies have the covers mounted thereon.

What is claimed:

1. A connector for splicing telephone cables each having at least a pair of wires therein, said connector comprising a body, a cover to be placed on said body and at least a pair of contact elements held in said body, each of said contact elements having a U-shaped wire receiving portion at one end thereof and a terminal at the other end thereof, said body having a plurality of wire cutoff pads respectively disposed adjacent to each of said contact elements in the path of a wire extending through said U-shaped wire receiving portion thereof, said cover having an edge portion formed with a plurality of wire cutoff holes which are arranged such that when said cover is placed on said body, the cutoff holes are disposed one above each said wire cut off pad whereby excess wire extending beyond said cutoff pad may be cut off through said cutoff holes.

2. A connector for telephone cables according to claim 1, wherein said wire cutoff holes are provided along the edge of said cover and spaced therefrom such that a hole covering portion remains.

3. A connector for telephone cables according to claim 2, wherein the edge portion including the wire cutoff holes and hole covering portions is divided into at least two portions of an approximately similar length, one of these divided portions being lowered from the other by the distance substantially corresponding to the thickness of said edge portion of the cover.

4. A connector for splicing two telephone cables, each having at least a pair of wires therein, said connector comprising a pair of bodies, a cover to be placed on each body and at least a pair of contact elements held in each body, each of said contact elements having a U-shaped wire receiving portion at one end thereof and a terminal at the other end thereof, the terminal on one body being adapted to mate with the terminal of the other contact element of the other body, each said body having a plurality of wire cutoff pads respectively disposed adjacent to each of said contact elements in the path of a wire extending through said U-shaped wire receiving portion thereof, each of said covers having an edge portion formed with a plurality of wire cutoff holes which are arranged such that when a cover is placed on a cooperating body one cutoff hole is located above each of said wire cutoff pads on said cooperating body, and each cover having hole covering means extending from said edge portion for covering the cutoff holes in the other cover of said pair of covers when said pair of bodies are placed in mating cable splicing position.

5. A connector according to claim 4 wherein said hole covering means comprises projecting portions of an approximately similar length, one of said projecting portions on one cover being lowered from the projecting portion of the other cover by the distance substantially corresponding to the thickness of said projecting portions of said covers to nest and project inward of said edge portions sufficiently to cover said cutoff holes.

6. A connector according to claim 4 wherein said hole covering means comprises projecting cover portions projecting beyond said edge portion of each cover sufficiently to cover the cutoff holes of said other cover and wherein said cover portions are divided to be disposed at different locations along said edge portion.

7. A connector according to claim 4 wherein said pair of bodies and said covers are identical and each cover has the edge portion divided into at least two portions with one of said two portions being positioned at a different distance above the associated wire cutoff pads than the other of said two portions and said hole covering means include portions projecting from said edge portions which mate with said two portions to cover said cutoff holes when said pair of bodies and said covers are joined together.

8. A connector according to claim 4 wherein said pair of bodies and said covers are identical and said bodies have ends, said terminals of said contact elements on each body comprise alternating male and female terminals and each of said bodies have a face adjacent said cutoff pads along which said terminals are positioned to mate with the terminal of the contact element of the other body, and each body has a male terminal at one end and a female terminal at the other end.

* * * * *

UNITED STATES PATENT AND TRADEMARK OFFICE

CERTIFICATE OF CORRECTION

PATENT NO. : 4,834,668

DATED : May 30, 1989

INVENTOR(S) : Terrance L. Markwardt

It is certified that error appears in the above-identified patent and that said Letters Patent is hereby corrected as shown below:

Column 1, Line 14, "any" should read --many--.

Column 2, Line 35, "connector" should read --contact--.

Column 2, Line 43, "alternatively" should read --alternately--.

Column 3, Line 18, "thinwalled" should read --thin-walled--.

Column 3, Line 56, "FIGS" should read --FIG--.

Signed and Sealed this

Third Day of August, 1993

*Attest:*

Michael K. Kirk

MICHAEL K. KIRK

*Attesting Officer*

*Acting Commissioner of Patents and Trademarks*